US006258048B1

(12) United States Patent
Montague

(10) Patent No.: US 6,258,048 B1
(45) Date of Patent: Jul. 10, 2001

(54) ELECTRO/MECHANICAL FOOT MASSAGER

(76) Inventor: David L. Montague, 1219 Glenwood Ave., Baltimore, MD (US) 21239

( * ) Notice: Subject to any disclaimer, the term of this patent is extended or adjusted under 35 U.S.C. 154(b) by 0 days.

(21) Appl. No.: 09/377,238

(22) Filed: Aug. 19, 1999

(51) Int. Cl.[7] ..... A61H 1/00; A61H 15/02

(52) U.S. Cl. ..... 601/19; 601/22; 601/28; 601/70; 601/115; 601/118; 601/122; 601/126; 601/128; 601/131

(58) Field of Search ..... 601/18–22, 27–32, 601/115, 70, 118, 122, 126–128, 131

(56) References Cited

U.S. PATENT DOCUMENTS 2,041,693 * 5/1936 Boltz et al. .
2,045,814 * 6/1936 Werler .
2,424,120 * 7/1947 Sandow .
3,083,709 * 4/1963 Lengsfeld .
5,176,598 * 1/1993 Gardner .
5,352,185 * 10/1994 Blauth et al. .
5,772,615 * 6/1998 Elder et al. .

FOREIGN PATENT DOCUMENTS

405042186 * 2/1993 (JP) ..... 601/126
406054885 * 3/1994 (JP) ..... 601/115

* cited by examiner

*Primary Examiner*—Danton D. DeMille

(57) ABSTRACT

An electric foot massaging assembly is provided including a slipper mount. A flexible slipper is positioned on the slipper mount with an opening formed in an upper extent thereof for receiving a foot therein. A roller assembly includes a plurality of rollers mounted on the slipper mount for massaging a foot within the slipper. A motor is included for rotating the rollers.

19 Claims, 4 Drawing Sheets

FIG.1
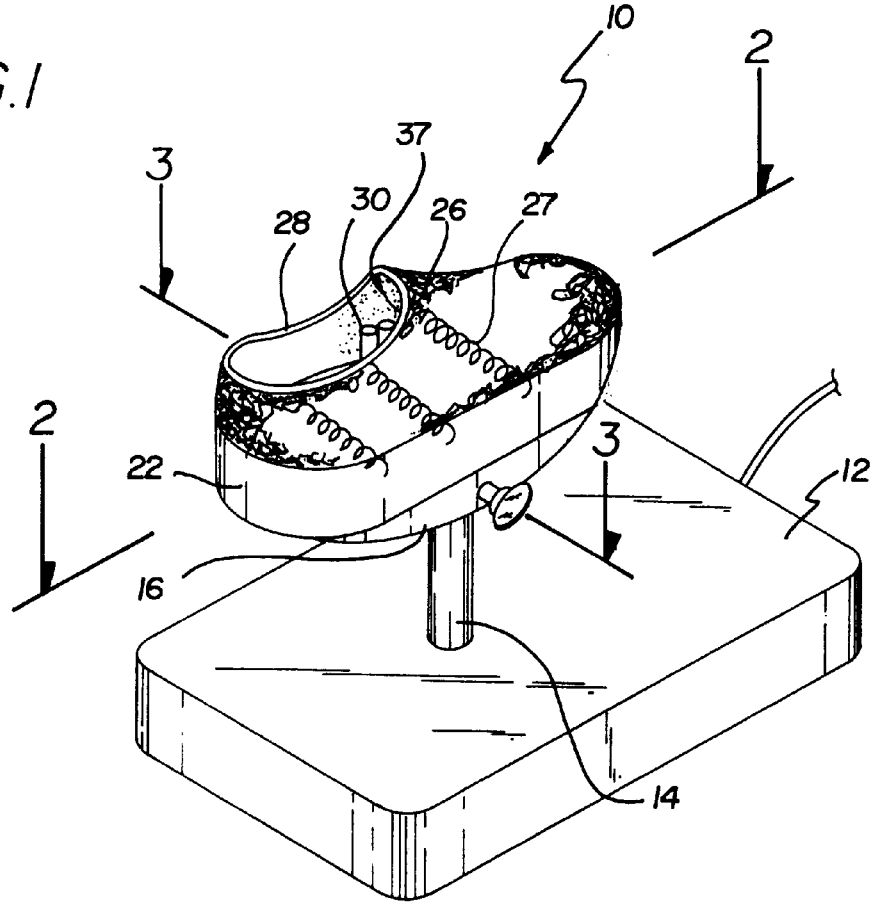
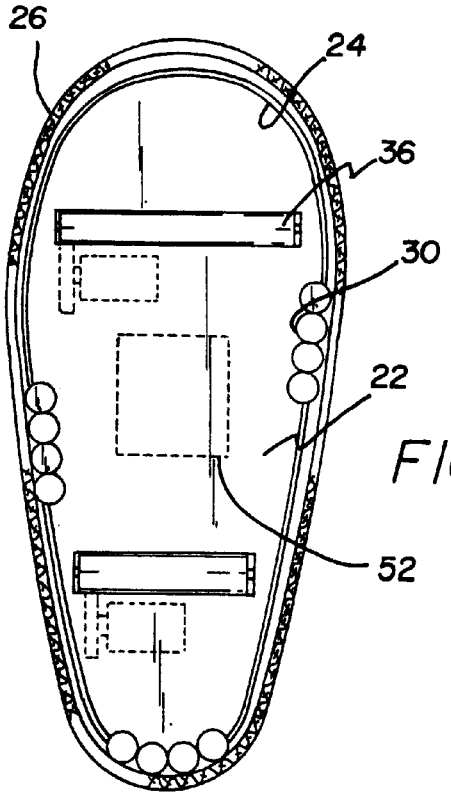
FIG.2

ELECTRO/MECHANICAL FOOT MASSAGER

BACKGROUND OF THE INVENTION

1. Field of the Invention

The present invention relates to foot massagers and more particularly pertains to a new electro/mechanical foot massager for massaging a foot while maintaining the same at a pre-selected angle.

2. Description of the Prior Art

The use of foot massagers is known in the prior art. More specifically, foot massagers heretofore devised and utilized are known to consist basically of familiar, expected and obvious structural configurations, notwithstanding the myriad of designs encompassed by the crowded prior art which have been developed for the fulfillment of countless objectives and requirements.

Known prior art foot massagers include U.S. Pat. No. 5,419,753; U.S. Pat. No. 4,198,962; U.S. Pat. Des. 351,659; U.S. Pat. No. 4,807,602; U.S. Pat. No. 4,347,838; and U.S. Pat. No. 5,251,620.

In these respects, the electro/mechanical foot massager according to the present invention substantially departs from the conventional concepts and designs of the prior art, and in so doing provides an apparatus primarily developed for the purpose of massaging a foot while maintaining the same at a pre-selected angle.

SUMMARY OF THE INVENTION

In view of the foregoing disadvantages inherent in the known types of foot massagers now present in the prior art, the present invention provides a new electro/mechanical foot massager construction wherein the same can be utilized for massaging a foot while maintaining the same at a pre-selected angle.

The general purpose of the present invention, which will be described subsequently in greater detail, is to provide a new electro/mechanical foot massager apparatus and method which has many of the advantages of the foot massagers mentioned heretofore and many novel features that result in a new electro/mechanical foot massager which is not anticipated, rendered obvious, suggested, or even implied by any of the prior art foot massagers, either alone or in any combination thereof.

To attain this, the present invention generally comprises a weighted base having a rectangular configuration. A post is coupled to a central extent of the base and extends upwardly therefrom to terminate at a top end. As shown in FIG. 3, the top end of the post is equipped with a square cross-section having a horizontally oriented smooth aperture formed therein. The base further includes a pivot member having a bottom portion with a square slot formed therein. As such, a fork is defined with a first leg having a smooth aperture formed therein and a second leg having a threaded aperture formed therein. In use, a threaded fastener is rotatably situated within the smooth apertures of the post and fork. The threaded fastener is further engaged with the threaded aperture of the fork for clamping the same about the post. By this structure, an angle of the pivot member may be selectively adjusted and fixed. Next provided is a rigid slipper mount having an oval bottom face, an oval top face, and a side wall mounted between peripheries of the top face and the bottom face for defining an interior space. The top face of the slipper mount has a peripheral slot formed therein adjacent to and spaced from the periphery of the top face. To maintain a central extent of the top face in place, a plurality of stanchions are preferably mounted between the top and bottom faces of the slipper mount. It should be noted that the bottom face of the slipper mount has the pivot member mounted along a central extent thereof. As such, the slipper mount may be pivoted with respect to the base about a horizontal axis. Also included is a flexible insulated slipper having a lower peripheral edge coupled to the periphery of the top face of the slipper mount. An opening is formed in an upper rear extent of the slipper for receiving a foot therein. As shown in FIG. 6, the slipper has a plurality of heating elements lining an interior surface thereof for generating heat upon the receipt of power. FIGS. 2 & 4 best shows a roller assembly including a plurality of vertically oriented peripheral rollers. Each of such peripheral rollers include an interconnect member coupled to a bottom end thereof and extending therefrom through the peripheral slot. The interconnect members of each of the peripheral rollers are connected via a cable. The peripheral rollers are coupled to the cable such that they are grouped into multiple spaced groups of adjacent rollers. These groups are adapted to be slidable along the peripheral slot coincidentally. The roller assembly further includes at least a pair of bottom rollers. Such bottom rollers are each rotatably coupled within laterally oriented slots formed in the top face of the slipper mount adjacent to a toe portion and a heel portion thereof. For effecting the rotation of the rollers, a motor assembly is provided including a pair of bottom roller motors each mounted to an underside of the top face of the slipper mount. A disk is mounted to a rotor of the bottom motors which remains in abutment with one of the bottom rollers to rotate the same upon the receipt of power. The motor assembly further includes at least one motor with a pulley in communication with the cable for moving the peripheral rollers along the peripheral slot.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new electro/mechanical foot massager apparatus and method which has many of the advantages of the foot massagers mentioned heretofore and many novel features that result in a new electro/mechanical foot massager which is not anticipated, rendered obvious, suggested, or even implied by any of the prior art foot massagers, either alone or in any combination thereof.

It is another object of the present invention to provide a new electro/mechanical foot massager which may be easily and efficiently manufactured and marketed.

It is a further object of the present invention to provide a new electro/mechanical foot massager which is of a durable and reliable construction.

An even further object of the present invention is to provide a new electro/mechanical foot massager which is susceptible of a low cost of manufacture with regard to both materials and labor, and which accordingly is then susceptible of low prices of sale to the consuming public, thereby making such electro/mechanical foot massager economically available to the buying public.

Still yet another object of the present invention is to provide a new electro/mechanical foot massager which provides in the apparatuses and methods of the prior art some of the advantages thereof, while simultaneously overcoming some of the disadvantages normally associated therewith.

Still another object of the present invention is to provide a new electro/mechanical foot massager for massaging a foot while maintaining the same at a pre-selected angle.

Even still another object of the present invention is to provide a new electro/mechanical foot massager that includes a slipper mount. A flexible slipper is positioned on the slipper mount with an opening formed in an upper extent thereof for receiving a foot therein. A roller assembly includes a plurality of rollers mounted on the slipper mount for massaging a foot within the slipper. A motor is included for rotating the rollers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new electro/mechanical foot massager according to the present invention.

FIG. 2 is a top cross-sectional view of the present invention taken along line 2—2 shown in FIG. 1.

DESCRIPTION OF THE PREFERRED EMBODIMENT

Figure 3:
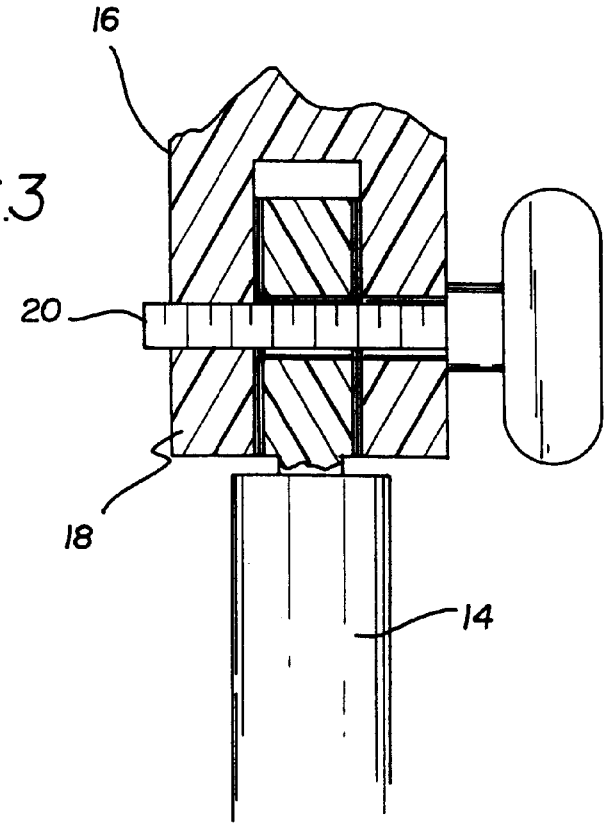
FIG. 3 is a cross-sectional view of the present invention taken along line 3—3 shown in FIG. 1.

With reference now to the drawings, and in particular to FIGS. 1 through 8 thereof, a new electro/mechanical foot massager embodying the principles and concepts of the present invention and generally designated by the reference numeral 10 will be described.

The present invention, designated as numeral 10, includes a weighted base 12 having a rectangular configuration. A post 14 is coupled to a central extent of the base and extends upwardly therefrom to terminate at a top end. As shown in FIG. 3, the top end of the post is equipped with a square cross-section having a horizontally oriented smooth aperture formed therein. The base further includes a pivot member 16 having a bottom portion with a square slot formed therein. As such, a fork 18 is defined with a first leg having a smooth aperture formed therein and a second leg having a threaded aperture formed therein.

In use, a threaded fastener 20 is rotatably situated within the smooth apertures of the post and fork. The threaded fastener is further engaged with the threaded aperture of the fork for clamping the same about the post. By this structure, an angle of the pivot member may be selectively adjusted and fixed.

Figure 4:
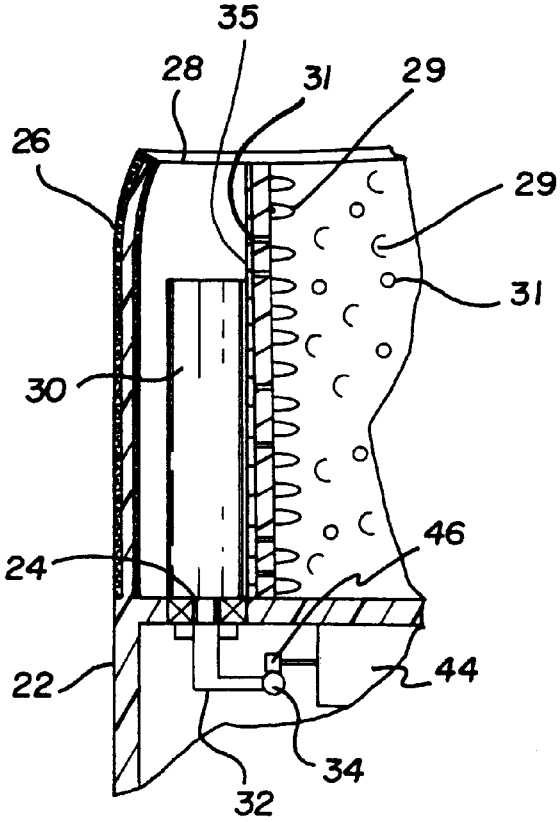
FIG. 4 is a side cross-sectional view of the present invention showing one of the peripheral rollers thereof.
Figure 5:
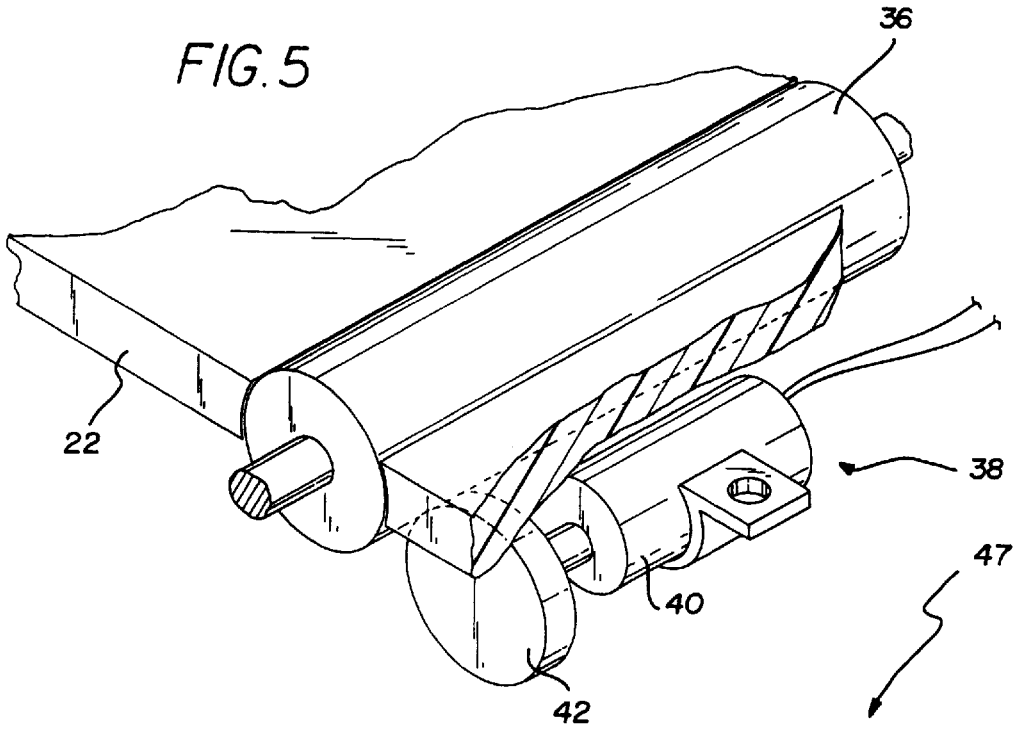
FIG. 5 is a detailed sectional view of one of the bottom rollers of the present invention.

Next provided is a rigid slipper mount 22 having an oval bottom face, an oval top face, and a side wall mounted between peripheries of the top face and the bottom face for defining an interior space. The top face of the slipper mount has a peripheral slot 24 formed therein adjacent to and spaced from the periphery thereof. The peripheral slot is preferably lined with a plurality of bearings, as shown in FIG. 4. To maintain a central extent of the top face in place, a plurality of unillustrated stanchions are preferably mounted between the top and bottom faces of the slipper mount. It should be noted that the bottom face of the slipper mount has the pivot member mounted along a central extent thereof. As such, the slipper mount may be pivoted with respect to the base about a horizontal axis for bending an ankle in a beneficial manner, as will soon become apparent.

Figure 6:
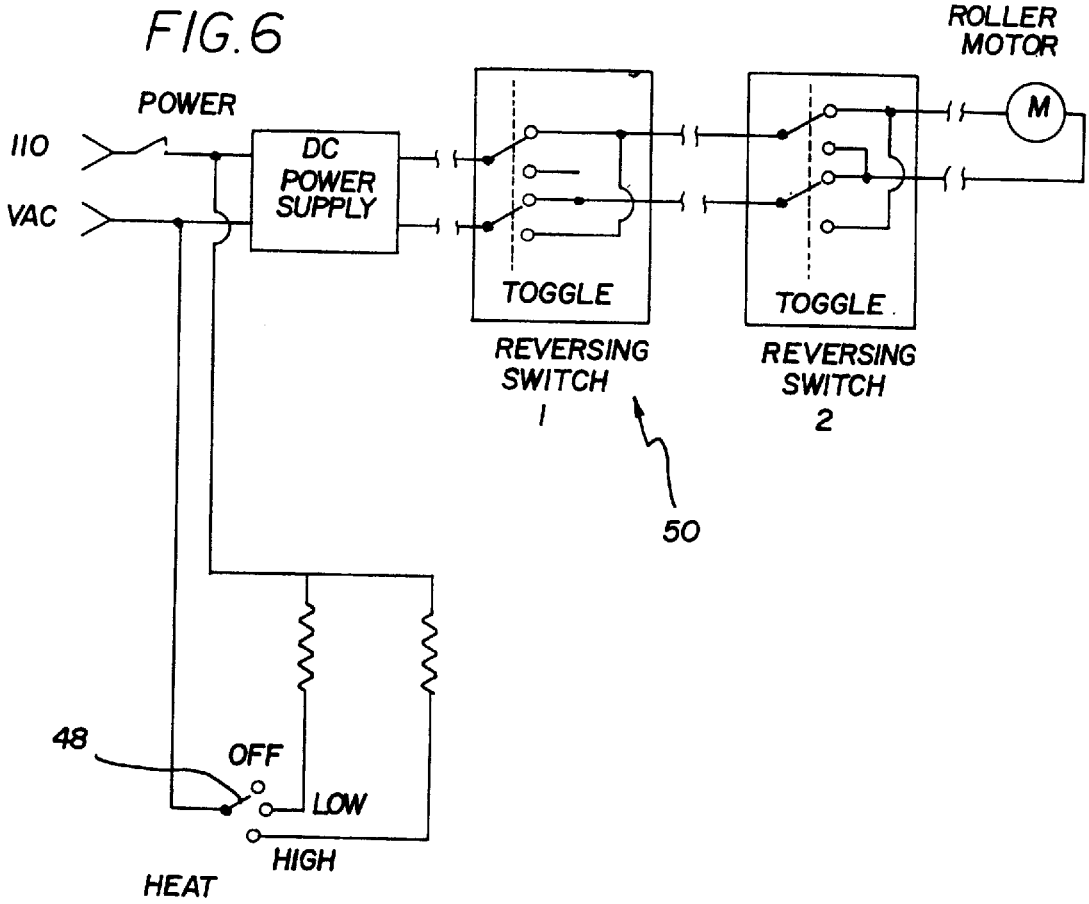
FIG. 6 is a schematic diagram of the present invention.

Also included is a flexible insulated slipper 26 having a lower peripheral edge coupled to the periphery of the top face of the slipper mount. For reasons that will become apparent, a toe of the slipper is upturned. Note FIG. 1. Further, as an option, an inner surface of the shoe is equipped with coil springs 27, elastic or any other type of contraction mechanism for conforming the same to a foot of a user. In the case of coil springs, the same are ideally positioned between side walls of the slipper mount which is flexible. Note FIG. 1. In the preferred embodiment, an outer surface of the slipper is lined with animal skin or any other type of soft material. Such lining is preferably removable and further interchangeable. As an option, the lining may take the form of various animal figurines such as a rabbit, puppy, or kitten. An opening 28 is formed in an upper rear extent of the slipper for receiving a foot therein. As shown in FIGS. 2 & 6, the slipper has a plurality of heating elements lining an interior surface thereof for generating heat upon the receipt of power.

FIGS. 2 & 4 best shows a roller assembly including a plurality of vertically oriented peripheral rollers 30. Each of such peripheral rollers include an interconnect member 32 coupled to a bottom end thereof and extending therefrom through the peripheral slot. Ideally, the peripheral rollers are rotatable with respect to the interconnect member about a vertical axis. The interconnect members of each of the peripheral rollers are connected via a cable 34. The peripheral rollers are coupled to the cable such that they are grouped into multiple equally spaced groups of adjacent rollers. These groups are adapted to be slidable along the peripheral slot coincidentally during. When the peripheral rollers are positioned at the upturned toe of the slipper, such peripheral rollers preferably angle inwardly.

As shown in FIG. 4, a flexible lining is positioned within the slipper with a plurality of ¼ inch rubber beads 29 and holes 31 formed therein. The peripheral rollers are situated between the flexible lining and the slipper such that the rollers urge the flexible lining inwardly against a foot of a user. It should be noted that the holes are adapted for ventilation purposes. In the preferred embodiment, an outer surface of the flexible lining is lined with magnet pieces 35 for adhering to the rollers which are also metallic. In the alternative, the magnet pieces may be positioned between the beads.

Figure 7:
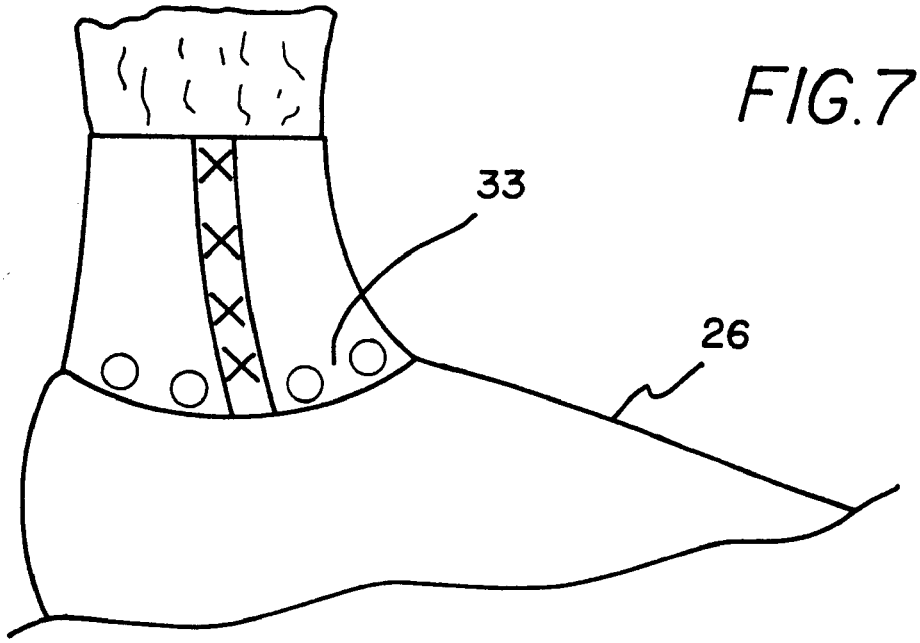
FIG. 7 is a side view of the ice pack of the present invention.
Figure 8:
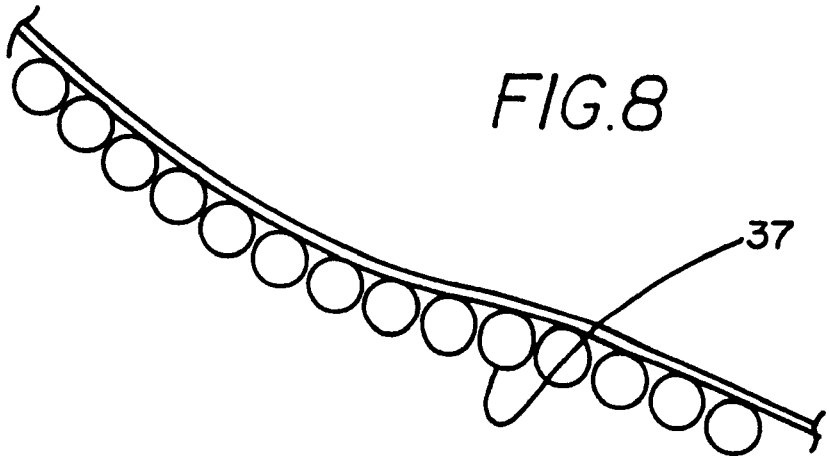
FIG. 8 is a side cross-sectional view of the upper rollers of the present invention.

As shown in FIG. 7, an ice pack 33 is provided with a tubular upper portion and an open diverging bottom portion. The ice pack has a slit formed therein which is lined with pile fasteners. In use, the ice pack is adapted for removably encompassing an ankle of the user in addition to an upper portion of the slipper. Ideally, a lower periphery of the bottom portion of the ice pack is lined with snaps for coupling about the opening of the slipper. Note FIG. 7. As an option, a vibrating mechanism may be attached directly to the ice pack for vibrating the same. It should be noted that the ice pack may be used by itself or in combination with the slipper.

The roller assembly further includes at least a pair of bottom rollers 36. Such bottom rollers are each rotatably coupled within laterally oriented slots formed in the top face of the slipper mount adjacent to a toe portion and a heel portion thereof. In the preferred embodiment, the rollers are constructed from a flexible, resilient material such as foam for conforming to feet of various sizes. As shown in FIGS. 1 & 7, a plurality of upper rollers 37 are freely rotatably mounted along an inner top surface of the slipper for massaging a top of a foot of a user. As an option, the upper rollers may be mechanized so to roll about either fixed axes or between a top and bottom of the shoe.

For effecting the rotation of the rollers, a motor assembly 38 is provided including a pair of bottom roller motors 40 each mounted to an underside of the top face of the slipper mount by way of an associated U-shaped bracket. A disk 42 is mounted to a rotor of the bottom motors which remains in abutment with one of the bottom rollers to rotate the same upon the receipt of power. The motor assembly further includes at least one motor 44 with a pulley 46 in communication with the cable for moving the peripheral rollers along the peripheral slot. The motor 44 thus moves the peripheral rollers via the cable in a manner similar to a gondola. As an option, the pulley and/or cable may be knurled or geared in order to improve frictional contact between the cable and pulley.

The present invention further includes a control assembly 47, as shown in FIG. 6. Such control assembly includes a selector switch 48 connected between a power source and the heating elements for selecting an amount of heat generated by the same. As an option, further included is a pair of limit switches 50 situated on diametrically opposed points on the peripheral slot of the slipper mount. The limit switches may be depressed by an extension on the interconnect member of one of the peripheral rollers. As such, the switches effect the reciprocation of the movement of the peripheral rollers during use. Ideally, the control assembly further controls a vibrating mechanism 52 mounted within the slipper mount for vibrating the entire present invention upon selective actuation.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An electric foot massaging assembly comprising, in combination:

a weighted base having a rectangular configuration with a post coupled to a central extent thereof and extending upwardly therefrom to terminate at a top end with a square cross-section having a horizontally oriented smooth aperture formed therein, the base further including a pivot member having a bottom portion with a square slot formed therein to define a fork with a first leg having a smooth aperture formed therein and a second leg having a threaded aperture formed therein, wherein a threaded fastener is rotatably situated within the smooth apertures of the post and fork and further engaged with the threaded aperture of the fork for clamping the same about the post, wherein an angle of the pivot member may be adjusted;

a rigid slipper mount having an oval bottom face, an oval top face, and a side wall mounted between peripheries of the top face and the bottom face for defining an interior space, the top face having a peripheral slot formed therein adjacent to and spaced from the periphery of the top face, the bottom face of the slipper mount having the pivot member mounted along a central extent thereof for allowing the slipper mount to be pivoted with respect to the base about a horizontal axis;

a flexible insulated slipper having a lower peripheral edge coupled to the periphery of the top face of the slipper mount and an opening formed in an upper rear extent thereof for receiving a foot therein, the slipper having a plurality of heating elements lining an interior surface thereof for generating heat upon the receipt of power;

a roller assembly including a plurality of vertically oriented peripheral rollers each having an interconnect member coupled to a bottom end thereof and extending therefrom through the peripheral slot, wherein the interconnect members of each of the peripheral rollers are connected via a cable such that the peripheral rollers are grouped into multiple spaced groups of adjacent rollers which are adapted to be slidable along the peripheral slot coincidentally, the roller assembly further including at least a pair of bottom rollers each rotatably coupled within laterally oriented slots formed in the top face of the slipper mount adjacent to a toe portion and a heel portion thereof;

a flexible lining positioned within the slipper with a plurality of beads and holes formed therein, wherein the peripheral rollers are situated between the flexible lining and the slipper such that the rollers urge the flexible lining inwardly;

a motor assembly including a pair of bottom roller motors each mounted to an underside of the top face of the slipper mount with a disk mounted to a rotor thereof which is in abutment with one of the bottom rollers for rotating the same upon the receipt of power, the motor assembly further including at least one motor with a pulley in communication with the cable for moving the peripheral rollers along the peripheral slot; and a vibrating mechanism mounted within the slipper mount for vibrating upon actuation.

2. An electric foot massaging assembly comprising:

a slipper mount;

a flexible slipper mounted on the slipper mount with an opening formed in an upper extent thereof for receiving a foot therein;

a roller assembly including a plurality of rollers mounted to the slipper mount for massaging a foot within the slipper;

a motor for rotating the rollers; and a pluraity of upper rollers rotatable mounted along an inner top surface of the slipper for massaging a top of a foot of a user.

3. An electric foot massaging assembly as set forth in claim 2 wherein the rollers are vertically oriented peripheral rollers adapted to circumnavigate the slipper of the massaging assembly.

4. An electric foot massaging assembly as set forth in claim 2 wherein the rollers include bottom rollers rotatably coupled within slots formed in a top face of the slipper mount beneath a foot of a user.

5. An electric foot massaging assembly as set forth in claim 2 wherein the slipper has a plurality of heating elements for generating heat upon the receipt of power.

6. An electric foot massaging assembly as set forth in claim 2 wherein the slipper mount is pivotally coupled to a base for being selectively pivoted about a horizontal axis.

7. An electric foot massaging assembly as set forth in claim 2 wherein the rollers are constructed from a flexible, resilient material.

8. An electric foot massaging assembly as set forth in claim 2 wherein a flexible lining is positioned within the slipper with a plurality of beads and holes formed therein, wherein the rollers are situated between the flexible lining and the slipper such that the rollers urge the flexible lining inwardly.

9. An electric foot massaging assembly as set forth in claim 8 wherein the flexible lining has beads protruding therefrom.

10. An electric foot massaging assembly as set forth in claim 8 wherein the flexible lining has holes formed therein.

11. An electric foot massaging assembly as set forth in claim 2 and further including an ice pack with a tubular upper portion and an open diverging bottom portion adapted to encompass an ankle of the user along with an upper portion of the slipper.

12. An electric foot massaging assembly as set forth in claim 2 wherein a vibrating mechanism is mounted within the slipper mount for vibrating upon actuation.

13. An electric foot massaging assembly as set forth in claim 2 wherein the slipper has a plurality of heating elements for generating heat upon the receipt of power.

14. An electric foot massaging assembly as set forth in claim 2 wherein the slipper mount is pivotally coupled to a base for being selectively pivoted about a horizontal axis.

15. An electric foot massaging assembly as set forth in claim 2 wherein the rollers are constructed from a flexible, resilient material.

16. An electric foot massaging assembly as set forth in claim 2 wherein a flexible lining is positioned within the slipper with a plurality of beads and holes formed therein, wherein the rollers are situated between the flexible lining and the slipper such that the rollers urge the flexible lining inwardly.

17. An electric foot massaging assembly comprising:

a slipper mount;

a flexible slipper mounted on the slipper mount with an opening formed in an upper extent thereof for receiving a foot therein;

a roller assembly including a plurality of rollers mounted to the slipper mount for massaging a foot in the slipper;

a motor for rotating the rollers; and a flexible lining positioned in the slipper with a plurality of beads and holes formed therein, wherein the rollers are situated between the flexible lining and the slipper such that the rollers urge the flexible lining inwardly, said beads protruding therefrom said flexible lining.

18. An electric foot massaging assembly as set forth in claim 17, wherein the rollers are vertically oriented peripheral rollers adapted to circumnavigate the slipper of the massaging assembly.

19. An electric foot massaging assembly as set forth in claim 17, wherein the rollers include bottom rollers rotatably coupled within slots formed in a top face of the slipper mount beneath a foot of a user.

* * * * *